United States Patent [19]

Rainis et al.

[11] 4,334,423

[45] Jun. 15, 1982

[54] WARHEAD FRAGMENTOMETER

[75] Inventors: Albert E. Rainis, Forest Hill; J. Terrence Klopcic, Bel Air, both of Md.

[73] Assignee: The United States of America as represented by the Secretary of the Army, Washington, D.C.

[21] Appl. No.: 210,957

[22] Filed: Nov. 28, 1980

[51] Int. Cl.[3] ..... G01N 33/22

[52] U.S. Cl. ..... 73/35; 73/167

[58] Field of Search ..... 73/35, 167; 273/373, 273/403

[56] References Cited

U.S. PATENT DOCUMENTS

| | | | |
|---|---|---|---|
| 197,398 | 11/1877 | O'Neil | 73/167 |
| 1,897,731 | 2/1933 | Manegold | 324/DIG. 2 |
| 3,361,962 | 1/1968 | Albrecht | 324/DIG. 2 |
| 3,893,336 | 7/1975 | Tucker | 73/167 |

*Primary Examiner*—James J. Gill

*Attorney, Agent, or Firm*—Nathan Edelberg; Robert P. Gibson; A. Victor Erkkila

[57] ABSTRACT

A method and apparatus are described for the determination of the mass and location of fragments from a warhead. The fragments are caught in a stack of soft panels placed in the line of fire. Each panel is then fed thru a reading device including an array of magnetometers and the data fed to a reduction computer.

4 Claims, 3 Drawing Figures

FIG. 1
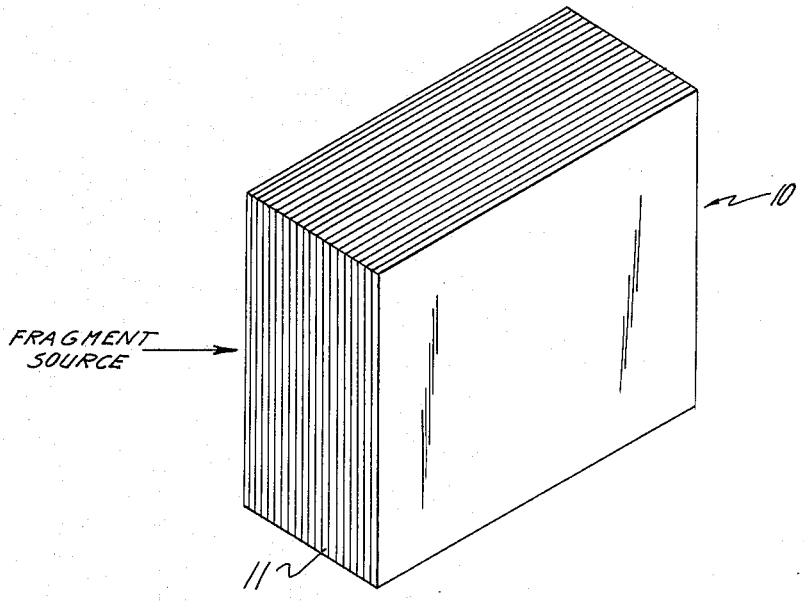
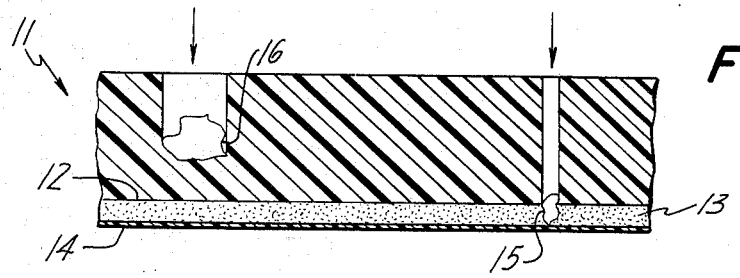
FIG. 2
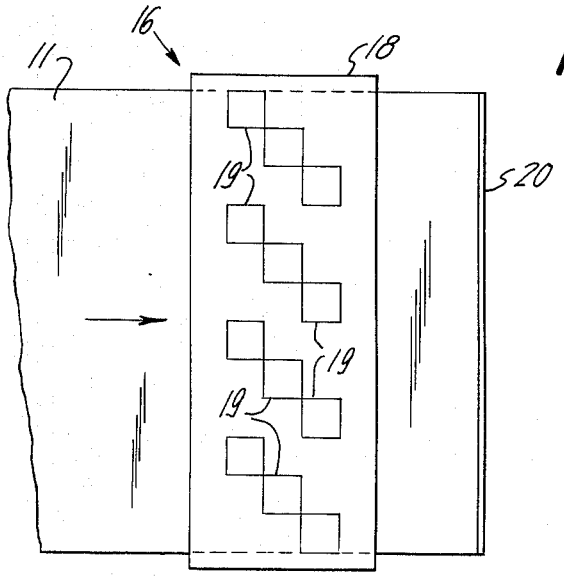
FIG. 3

WARHEAD FRAGMENTOMETER

GOVERNMENTAL INTEREST

The invention described herein may be manufactured, used and licensed by or for the Government for Governmental purposes without the payment to us of any royalties thereon.

BACKGROUND OF THE INVENTION

In the design of warheads, it is important to determine the fragmentation or spallation patterns behind the armor. Heretofore, witness plates have been employed to stop fragments and then the fragments were located by visual detection of the holes they produced in the face of the witness plate. The penetration depth of each fragment was measured with a mechanical probe. Finally, the fragments were "dug out" manually and weighed. This process was quite time-consuming and liable to errors, especially in the overlooking of small fragments.

The instant invention eliminates the activity where human error can occur. It locates the fragments and deduces their masses automatically.

SUMMARY OF THE INVENTION

The object of the invention is to provide a method and apparatus for accurately determining the fragmentation characteristics of shell-pierced armor.

The invention includes improvements in two areas with the first found in the design of the panel stack. The individual fragment impingement panel is a unique design to prevent the loss of very small fragments. The panel is composed of a rigid but easily penetrated non-magnetic foam, such as celotex, and adhered to the side opposite the entry plane of the fragment is a tape or membrane that will trap very small fragments and prevent them from becoming lost when the panel stack is disassembled.

After being subject to firing, the panel stack is disassembled and each panel is fed into an apparatus that reads the location and mass of the fragments and feeds the information to a reduction computer. An essential component of this apparatus is the magnetometer.

BRIEF DESCRIPTION OF THE DRAWINGS

FIG. 1 shows a stack of panels positioned with its front face normal to the direction of the fragment source. The supporting means has not been shown.

FIG. 2 is a cross-sectional view of a segment of a single panel.

FIG. 3 is a schematic representation of the side view of a fragmentometer or apparatus for reading the mass and location of all fragments on each panel.

DETAILED DESCRIPTION OF THE INVENTION

FIG. 1 shows a stack 10 of specially designed panels 11; the construction of each panel is shown in FIG. 2. The panels consist of an appropriate fragment stopping or retaining material such as 4 ft.×8 ft. celotex sheets as manufactured by U.S. Gypsum. The panel face 12 opposite the fragment entry face has a layer of adhesive 13 bonded to it and this layer is then covered by a thin film or tape 14. This construction holds fragments which would otherwise stop in the plane between panels. This is especially important with very small fragments 15 that may get lost during the disassembly of the panel stack. Another fragment 16 is shown at an intermediate position. All materials used in the construction of the panel 11 must be non-magnetic.

The panel stack is set-up far enough from the fragment source or warhead to escape any blast effects. Typically ten meters is a reasonable distance. On exposure to the blast, the stack is disassembled and each panel is passed through a fragmentometer 16 schematically shown in FIG. 3.

The fragmentometer is a structure 18 with an opening providing for the passage of panels 11 with a minimum clearance. An array of magnetometers 19 is assembled on the side of the structure 18 in such a manner that all longitudinal elements of the panel 11 are scanned as it is fed thru the opening. At least the leading and trailing edges of the panel 11 should have attached magnetic material 20 in order to provide a "synch pulse" to register start/stop during the passage of the panel. Signals from each magnetometer are fed thru separate channels into a data reduction computer, not shown.

It is of concern to separate individual fragments, rather than have more than one appear as one, larger fragment. Several conditions serve to make it highly unlikely that two fragments would be counted simultaneously. First, by using fairly thin panels, only those fragments with nearly identical stopping characteristics will stop in the same panel. Since fragments in a given direction tend to have similar velocities in many experiments, this identical stopping requirement tends to require the particles in a panel to have identical masses. Furthermore, the separation between fragment source and panel requires the emitted angle to be nearly identical. Thus, the selective effect of thin panels coupled with tight angular resolution make double fragment detection unlikely.

Magnetometer response is proportional to the effective permeability of the detected substance and, therefore, determination of the mass of the fragment should be reasonably accurate. Fortunately, most fragments of interest will be ferrous materials and for such materials, the induced ferromagnetism is the dominant contributor to permeability. Induced ferromagnetism is a bulk property, i.e. relatively insensitive to shape; hence, the magnetometer response should be directly proportional to mass. Since samples of fragment material should be readily available, calibration procedures will be straightforward and accurate.

The sensitivity of a magnetometer (ability to detect small fragments or small differences in fragment sizes) depends upon the method used to measure the change in magnetometer inductance caused by the presence of a fragment in the viewing range of the magnetometer. The instant invention may employ an inductance bridge, a well known technique which offers excellent sensitivity, coupled to circuitry which will digitize the output of the bridge. This digitized output is then available for further data processing, such as by a digital computer.

The use of an inductance bridge offers a ready technique to avoid "cross-talk" (mutual interference) between adjacent magnetometers. Each magnetometer can be operated at its own, unique frequency. Signals from each magnetometer are passed through a band-pass filter, a common device used to accept only selected frequencies. Thus, unwanted signals from adjacent magnetometers may be rejected by proper choice of frequencies and filters.

The invention described should be a marked improvement, in both speed and reliability, over manual fragment counting techniques. A fragmentometer designed to handle 4 ft.×8 ft. panels could easily fit in a semi-trailer allowing on-site data reduction.

There are a number of variables such as panel thickness, size and number; magnetometer size and array; and the computer program required to print out the desired data. These are a function of blast size and/or distance or otherwise well-known to those skilled in the art. Inclusion of these design details would not add to the scope of the invention.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

What is claimed is:

1. A method of determining the fragment mass and patterns from an exploded warhead, which comprises:

(a) placing a stack of non-magnetic, penetratable panels in the path of the projecting fragments;

(b) disassembling the stack of panels; and (c) feeding each panel through a reading device that determines the mass and location of each fragment in the respective panel.

2. A method as recited in claim 1 further comprising: locating an adhesive layer and film on the rearward face of each of the panels for entrapping very small fragments.

3. A method as recited in claim 1, further comprising: placing an array of magnetometers on the reading device whereby any size fragment can be located on the entire panel; and feeding the signals of each magnetometer to a data reduction computer.

4. A method as recited in claim 1, further comprising: operating each magnetometer at a selected frequency so as to minimize mutual interference between adjacent magnetometers.

* * * * *